US006642820B2

(12) United States Patent
Emura et al.

(10) Patent No.: US 6,642,820 B2
(45) Date of Patent: Nov. 4, 2003

(54) PROTECTIVE SWITCH

(75) Inventors: Takeshi Emura, Saitama (JP); Koji Asakawa, Saitama (JP); Katsunori Kuboyama, Saitama (JP); Hisao Kawata, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/209,656

(22) Filed: Aug. 1, 2002

(65) Prior Publication Data

US 2003/0024800 A1 Feb. 6, 2003

(30) Foreign Application Priority Data

Aug. 6, 2001 (JP) ..... 2001-237741

(51) Int. Cl.[7] ..... H01H 83/00
(52) U.S. Cl. ..... 335/17; 335/132; 340/638
(58) Field of Search ..... 340/638–640; 335/6–13, 17, 21, 132, 202

(56) References Cited

U.S. PATENT DOCUMENTS 3,806,686 A * 4/1974 Gaskill ..... 200/308
3,820,046 A * 6/1974 Layton et al. ..... 335/13
3,973,230 A * 8/1976 Ciarcia et al. ..... 335/13
4,211,989 A * 7/1980 Acampora ..... 335/17
4,246,557 A * 1/1981 Michetti et al. ..... 335/17
4,246,558 A * 1/1981 Zubaty et al. ..... 335/20
4,595,812 A * 6/1986 Tamaru et al. ..... 200/307
4,804,933 A * 2/1989 Becker et al. ..... 335/186
6,040,746 A * 3/2000 Maloney et al. ..... 335/13
6,411,183 B1 * 6/2002 Yamagata et al. ..... 335/6
6,507,255 B1 * 1/2003 Ennis et al. ..... 335/6
6,559,745 B2 * 5/2003 Yamagata et al. ..... 335/132
2002/0079992 A1 * 6/2002 Yamagata et al. ..... 335/17

FOREIGN PATENT DOCUMENTS

JP 6-68772 3/1994

* cited by examiner

*Primary Examiner*—Elvin Enad
*Assistant Examiner*—Bernard Rojas
(74) *Attorney, Agent, or Firm*—Kanesaka & Takeuchi

(57) ABSTRACT

A protective switch includes a switch housing, a switching mechanism for closing and opening a movable contact, a tripping mechanism instantaneously pulling a plunger upon detection of an instant current, a tripping control device, an alarm switch, and a trip member. The trip member is divided into an upper trip member away from a bottom of the housing, and a lower trip member close to the bottom of the housing urged by a back spring. The upper trip member includes a plunger operating section opposed to an operating member of the plunger and a switch operating section opposed to an actuator of the alarm switch. The lower trip member includes a locking member operating section opposed to a locking member of a switching mechanism and a tripping section opposed to an operating member of a tripping control device.

3 Claims, 5 Drawing Sheets

PROTECTIVE SWITCH

BACKGROUND OF THE INVENTION AND RELATED ART STATEMENT

The invention relates to a protective switch for use as a breaker or a switch to protect a low-voltage indoor electric line or a device from over-current. More particularly, the invention relates to a tripping device of the protective switch.

Generally, a protective switch of this kind has an over-current tripping device incorporated therein, which acts on a locking member of a switching mechanism upon detection of over-current and releases the locked switching mechanism to cause a breaking action (tripping). Usually, the over-current tripping device carries out time-delay tripping in which an overload current is tripped with lapse of a delay time corresponding to a current value, and carries out instantaneous tripping in which large current such as short-circuit current is tripped instantaneously. An alarm switch may be attached to the protective switch as an auxiliary device. If the protective switch is instantaneously tripped due to a large accidental current, the alarm switch sends an electric signal to warn an external device, and further indicates mechanically on a front surface of the switch.

Examples of a tripping control device for the protective switch include a voltage tripping device and an under-voltage tripping device. The voltage tripping device is used to control the protective switch from a distance, and trips the protective switch when a predetermined voltage is applied thereto. On the other hand, the under-voltage tripping device constantly monitors a circuit voltage, and if the circuit voltage becomes lower than a specified value, the under-voltage tripping device trips the protective switch. An alarm switch and tripping control device are ordinarily mounted on a side of a body of the protective switch.

FIG. 5 is a longitudinal sectional view showing a conventional triple pole protective switch that includes an electromagnetic over-current tripping mechanism with an instantaneous tripping characteristic (hereinafter referred to as "instantaneous tripping mechanism") and a thermally-actuated over-current tripping mechanism with a time-delay tripping characteristic (hereinafter referred to as "time-delay tripping mechanism") as over-current tripping devices. In FIG. 5, each of phase circuits housed in a switch body housing 1 is comprised of a pair of fixed contacts 2, 3 and a movable contact 4 that bridges the pair of fixed contacts 2, 3. The movable contact 4 is pressed against the fixed contacts 2, 3 by a contact spring 5 comprised of a compression coil spring inserted between the movable contact 4 and a housing bottom 1*a* to close the circuit. The movable contact 4 is held by a three-phase integrated movable contact holder 6 formed of an insulating material, and the movable contact holder 6 is movably guided by the housing 1 in a vertical direction with respect to the housing bottom in a vertical direction in FIG. 5.

A power supply-side terminal 7 is integrated with the fixed contact 2, and the fixed contact 3 is connected to a lower end of a bimetal 8*a* of a time-delay tripping mechanism 8. An upper end of the bimetal 8*a* is connected to one end of a heater 8*b*. The heater 8*b* is wound on the bimetal 8*a* through an insulating material (not shown) and the other end of the heater 8*b* is connected to one end of an electromagnetic coil 9*a* of an instantaneous tripping mechanism 9. The other end of the electromagnetic coil 9*a* is connected to a load-side terminal 10. The instantaneous tripping mechanism 9 is constructed such that the electromagnetic coil 9*a* wound around a cylindrical bobbin 9*c* is positioned vertically with respect to the housing bottom 1*a* in a U-shaped yoke 9*b*, and a cylindrical plunger 9*d* is slidably inserted into the bobbin 9*c*. An operating member 9*e* is joined to a head of the plunger 9*d*, and the plunger 9*d* forced upward in FIG. 5 by a return spring 9*f* is fixed with the operating member 9*e* being in contact with an upper end of the yoke 9*b*.

A switching mechanism 11 has a pair of right and left opening and closing levers 13 that rotate around a switching shaft 12. Ends of the levers 13 stay at both sides of the instantaneous tripping mechanism 9 at a central pole and above the movable contact holder 6 in the circuit-closed state as shown in FIG. 5. The switching mechanism 11 is operated by a butterfly-shaped operating handle 14 projecting from the housing 1, and a latch 17 is locked at a latch receiver 26 while the pair of breaking springs 25 formed of a torsion spring is wound.

FIG. 6 is a front view showing a reset state of the switching mechanism 11, taken along line (6)—(6) in FIG. 5, and FIG. 7 is a front view showing a tripping state of the switching mechanism in FIG. 6. The switching mechanism 11 is constructed as an integral unit such that mechanical parts are supported on a frame 15 having front and rear side plates (the front side plate is omitted from FIGS. 6 and 7). The operating handle 14 is supported on the frame 15 such that it is capable of pivoting around a handle shaft 16, and the latch 17 is rotatably supported on the handle shaft 16. An upper end of an upper link 18 is connected to the operating handle 14 via a shaft 19, and an upper end of a lower link 20 is connected to a lower end of the upper link 18 via one end 21*a* of a U-shaped pin 21. The U-shaped pin 21 has the other end 21*b* rested on the latch 17 so that the latch 17 locks the upper link 18 and the lower link 20. The upper link 18 and the lower link 20 constitute a toggle link.

A transmission pin 22 is connected to a lower end of the lower link 20, and both ends of the transmission pin 22 are slidably inserted into a slot 23 formed in the side plates of the frame. Another transmission pin 24 is connected to the switching levers 13 such that the pin 24 crosses a transmission pin 16. The pair of switching levers 13 is connected to the switching shaft 12, which has both ends supported on the housing 1, with an interval formed therebetween, and the transmission pin 24 is bridged between the right and left switching levers 13. The switching shaft 12 is rotatably supported on the housing 1, and the pair of breaking springs 25 is fitted into the switching shaft 12 with one end of the breaking spring 25 being engaged with the transmission pin 24 and the other end thereof being engaged with the frame 15. The breaking spring 25 is twisted in an ON state in FIG. 6, and applies a push-up force P from the transmission pin 24 to the transmission pin 22 so as to rotate the switching levers 13 clockwise in FIG. 5.

The push-up force P causes the transmission pin 22 of the lower link 20 to move upward along the slot 23. As a result, the entire lower link 20 tries to rotate counterclockwise in FIG. 6, but is kept in a position shown in FIG. 6 since the U-shaped pin 21 locks the upper end thereof. The lower link applies a tensile force Q to the latch 17 via the U-shaped pin 21. As a result, the latch 17 tries to rotate clockwise in FIG. 6 around the handle shaft 16, but is kept in a position shown in FIG. 6 since it is locked by the latch receiver 26 serving as a locking member.

The latch receiver 26 is a vertically extended plate having a pair of right and left bent arms 26*a* at a substantially intermediate position thereof, and has a quadrate window hole formed in the plate near the arms 26*a*. The latch receiver 26 is rotatably supported on the frame 15 via a shaft 27 extending through the arms 26*a*, and has an engagement portion 26*b*, positioned at the lower edge of the window hole to engage an L-shaped portion 17*a* of the latch 17 to lock the latch 17. In response to pressure applied by the latch 17, the latch receiver 26 tries to rotate clockwise in FIG. 6, but is inhibited from rotating and kept in an upright position shown in FIG. 6 since a tongue piece 26*c* projecting from the latch receiver 26 to the right and left is brought into contact with a side edge of a notch of the frame 15. It should be noted that a return spring 28 formed of a helical compression coil spring is inserted between a lower end of the latch receiver 26 and the frame 15, and the latch receiver 26 is forced clockwise in FIG. 6.

In the circuit-closed state in FIG. 5, current flows from the power supply-side terminal 7 to the load-side terminal 10 via the fixed contact 2, the movable contact 4, the fixed contact 3, the bimetal 8*a*, the heater 8*b*, and the electromagnetic coil 9*a*. When a current flowing through a circuit breaker becomes overloaded with twice or three times higher than a rated current, the bimetal 8*a* heated by the heater 9*b* is curved. After a delayed time according to a current value, an operating end portion of the latch receiver 26 rotates counterclockwise in response to a tripping force R in FIG. 6 applied via a transmission mechanism (not shown). This releases the locked switching mechanism 11 to rotate the latch 17 clockwise. As a result, the toggle links 18, 20 are bent, and the switching levers 13 are rotated clockwise in FIG. 5 due to the force of the breaking springs 25. The switching levers 13 push down the movable contact 4 via the movable contact holder 6, and separate the movable contact 4 from the fixed contacts 2, 3 to shut off the current (time-delay tripping action).

FIG. 7 shows the tripping state of the switching mechanism 11. To reset the tripping switching mechanism 11 back to the state in FIG. 6, the operating handle 14 is turned clockwise in FIG. 7. The toggle links 18, 20 are extended to press the U-shaped pin 21 to the right. The latch 17 is lifted counterclockwise around the handle shaft 16 as pivot, and the L-shaped portion 17*a* of the latch 17 engages the engagement portion 26*b* of the latch receiver 26 that has been brought into an upright position again by the return spring 28.

On the other hand, when a heavy current (hereinafter referred to as "an instant current") that is twelve to thirteen times larger than a rated current flows through the circuit breaker, the instantaneous tripping mechanism 9 operates to cause instantaneous tripping. Namely, when the heavy current flows through the electromagnetic coil 9*a*, the plunger 9*d* is instantaneously pulled against the return spring 9*f* and releases the latch 17 locked by the latch receiver 28 via a trip member 29 (FIG. 5). And, the protective switch trips (an instantaneous tripping action). The trip member 29 is formed of an insulating plate, and is guided on a groove on the housing 1 along the frame side plate by a side of the instantaneous tripping mechanism of the switching mechanism 11 in FIG. 5 such that the trip member 29 is capable of moving vertically with respect to the bottom of the housing 1.

FIG. 8 is a front view showing the trip member 29. In FIG. 8, plunger operating sections 29*a* facing ends of the operating member 9*e* integrated with the plunger 9*d* of the instantaneous tripping mechanism 9 at each pole are formed at three positions on a top end surface of the trip member 29. A window hole 30, into which the latch receiver 26 is fitted, is formed in the trip member 29, and a locking member (a latch receiver) operating section 29*b* formed of an inclined face that presses the latch receiver 26 is formed as a part of the peripheral edge of the window hole 30. A tripping section 29*c* facing an operating member of a tripping control device described later is formed at an upper left shoulder of the trip member 29 in FIG. 8. Further, a U-shaped notch 31 is formed at a right side of the trip member 29 in FIG. 8, and a switch operating section 29*d* facing an actuator of an alarm switch described later is formed at an upper edge of the notch 31.

FIGS. 9 to 11 are cross-sectional views of the protective switch taken along the trip member 29, wherein FIG. 9 shows the reset state, FIG. 10 shows the tripping state caused by the instant current, and FIG. 11 shows the tripping state caused by the tripping control device. First, in FIG. 9, the trip member 29 is forced by a back spring 32 formed of a compression coil in a direction away from the housing bottom portion 1, then is brought into contact with a stopper (not shown) formed and bent on the frame 15 of the switching mechanism 11. The operating member 9*e* integrated with the plunger 9*d* of the instantaneous tripping mechanism 9 is positioned in proximity to the plunger operating sections 29*a* of the trip member 29 to oppose thereto.

A tripping control device 33 comprised of a voltage tripping device or an under-voltage tripping device is mounted on a left side of the protective switch housing 1, and an operating member 33*a* that outputs an operation of the tripping control device 33 is positioned in proximity to the tripping section 29*c* of the trip member 29 to oppose thereto. An alarm switch 34 for transmitting the instantaneous tripping action of the protective switch to an external device via an electric signal is mounted on a right side of the protective switch housing 1, and an actuator 34*a* of the alarm switch 34 is opposed to the switch operating section 29*d* of the trip member 29. The actuator 34*a* is constructed as a lever that is rotatably supported by a shaft 34*b*, and is urged in the clockwise direction in FIG. 9 by a torsion spring (not shown). An alarm contact (not shown) and an action display rod 34*c* are provided inside the alarm switch 34, and the action display rod 34*c* is locked by the actuator 34*a* in the state shown in FIG. 9 and is held in an embedded state.

When a heavy current such as a short-circuit current flows in the state in FIG. 9, the instantaneous tripping mechanism 9 instantaneously pulls the plunger 9*d*. As a result, the operating member 9*e* pushes the trip member 29 down by a stroke S via the plunger operating section 29*a*, as shown in FIG. 10. The lowered trip member 29 moves the latch receiver 26 to the left in FIG. 9 by means of the latch receiver operating section 29*b* comprised of an inclined face. The locked switching mechanism 11 is released to cause the protective switch to trip. At the same time, the trip member 29 rotates the actuator 34*a* of the alarm switch 34 via the switch operating section 9*d*. The alarm contacts are switched to transmit a trip signal, and the display rod 34*c* is pushed by a spring (not shown) to project from the alarm switch 34 to indicate an occurrence of the instantaneous tripping.

In the state shown in FIG. 9, when the tripping control device 33 operates in response to an input of a tripping instruction to the voltage tripping device or to a drop in the circuit voltage by the under-voltage tripping device, the operating member 33*a* moves downward in FIG. 9 to push down the trip member 29 via the tripping section 29*c*. Accordingly, the latch receiver 26 moves and trips the protective switch. In the reset state in FIG. 9, there is a gap G between the switch operating section 29*d* of the trip member 29 and the actuator 34*a* of the alarm switch 34, and a downward stroke s (FIG. 11) during the operation of the tripping control device 33 is set to be smaller than the gap G (s<G<S). Therefore, during the operation of the tripping control device 33, the switch operating section 29*d* of the lowered trip member 29 can not reach the actuator 34*a*, and does not operate the alarm switch 34. Namely, the tripping action by the tripping control device 33 and the instantaneous tripping action by the instantaneous tripping mechanism 9 are separated from each other, and the alarm switch 34 is operated only during the instantaneous tripping action.

Conventionally, in the reset state (FIG. 9), the gap G is provided between the switch operating section 29*d* of the trip member 29 and the actuator 34*a* of the alarm switch 34, and the operational stroke s of the tripping control device 33 is set to be smaller than the gap G, so that the alarm switch 34 can be operated only during the instantaneous tripping action. There is no problem with this structure in the case where an instant current is as large as a short circuit current. However, an absorption stroke of the plunger 9*d* might become smaller than the gap G in a range near the lower limit of an operational current value of the instantaneous tripping mechanism 9, and if it is the case, the alarm switch 34 can not be operated even during the instantaneous tripping action. It is difficult to perfectly adjust the absorption stroke S of the plunger 9*d*, the operational stroke s of the tripping control device 33, and the gap G in order to solve the above-mentioned problem because there is a variation in operational characteristics and dimensional accuracy of the parts.

It is therefore an object of the present invention to provide a protective switch that is capable of inhibiting an alarm switch from operating during a tripping caused by a tripping control device, and surely operating the alarm switch in an entire range of an instant current.

Further objects and advantages will be apparent from the following description of the invention.

SUMMARY OF THE INVENTION

To attain the above objects, in a protective switch of the invention, a trip member is divided into an upper trip member away from a bottom of a housing and a lower trip member close to the bottom of the housing. The lower trip member is urged by a back spring, and the upper trip member is formed of a plunger operating section opposed to an operating member of a plunger and a switch operating section opposed to an actuator of an alarm switch. The lower trip member is formed of a locking member operating section opposed to a locking member of a switching mechanism and a tripping section opposed to an operating member of a tripping control device.

According to the present invention, the tripping control device is capable of tripping the protective switch by moving only the lower trip member independently from the upper trip member that operates the alarm switch. Accordingly, a gap between the switch operating section of the upper trip member and the actuator of the alarm switch can be minimized, regardless of an operational stroke of the tripping control device. Thus, it is possible to operate the alarm switch in an entire range of an instant current. When the instant current flows, the operating member of the plunger moves the upper trip member to push down the lower trip member and move the locking member of the switching mechanism, thus causing instantaneous tripping.

DETAILED DESCRIPTION OF PREFERRED EMBODIMENTS

Figure 1:
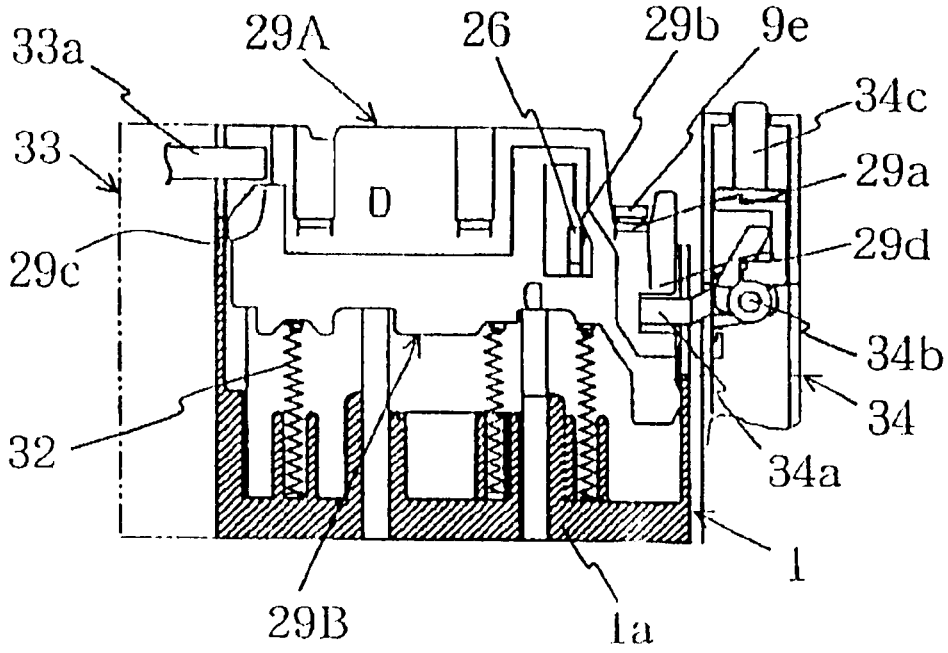
FIG. 1 is a cross-sectional view showing a principal part of a trip member of a protective switch in a reset state according to an embodiment of the present invention.
Figure 2:
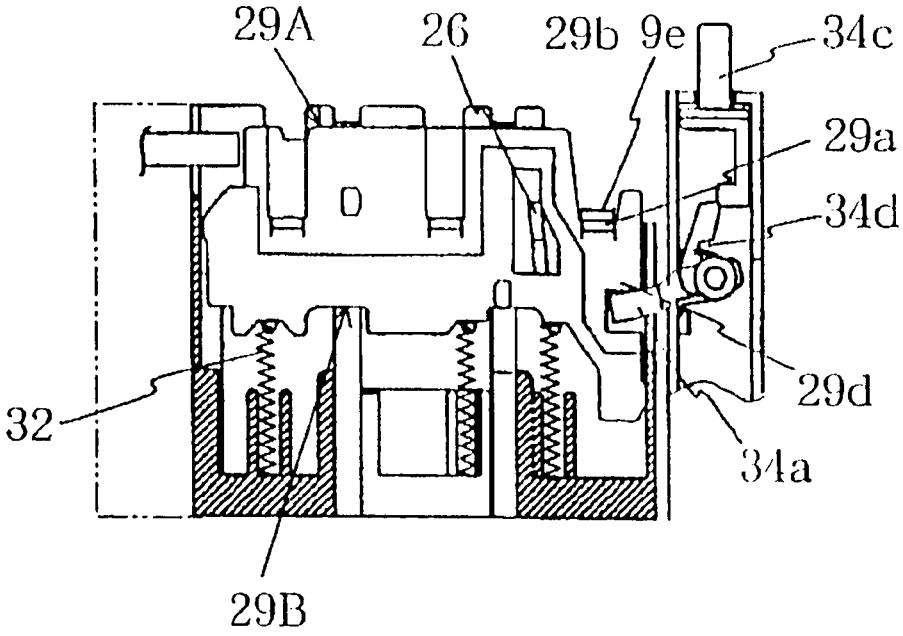
FIG. 2 is a cross-sectional view showing the trip member of the protective switch in FIG. 1, which is tripping in response to an operation of an instantaneous tripping mechanism.
Figure 3:
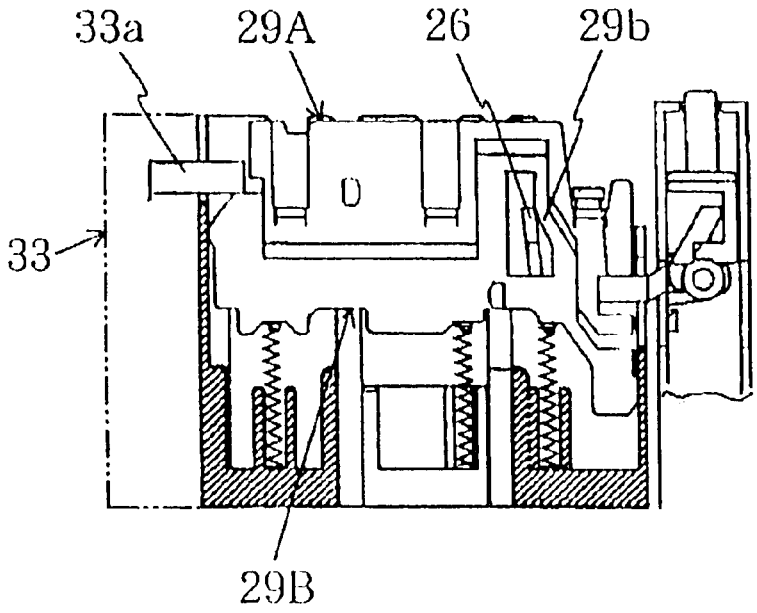
FIG. 3 is a cross-sectional view showing the trip member of the protective switch in FIG. 1, which is tripping in response to an operation of a tripping control device.
Figure 4:
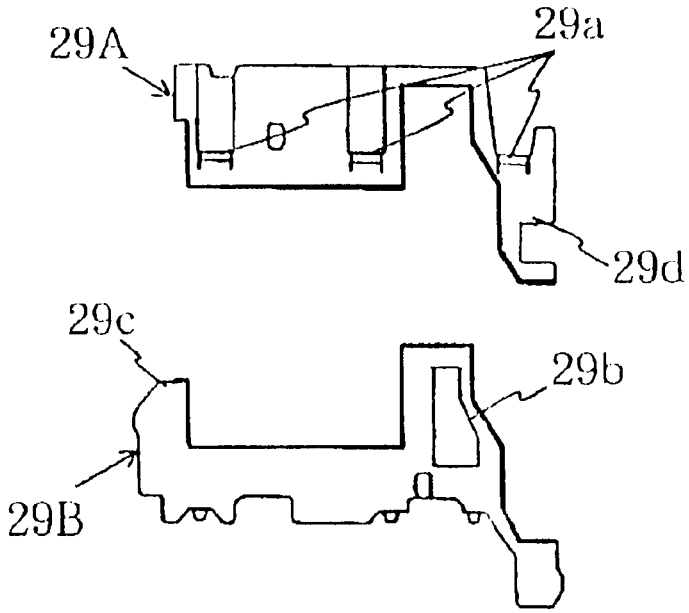
FIG. 4 is an exploded front view showing the trip member of the protective switch in FIG. 1.
Figure 5:
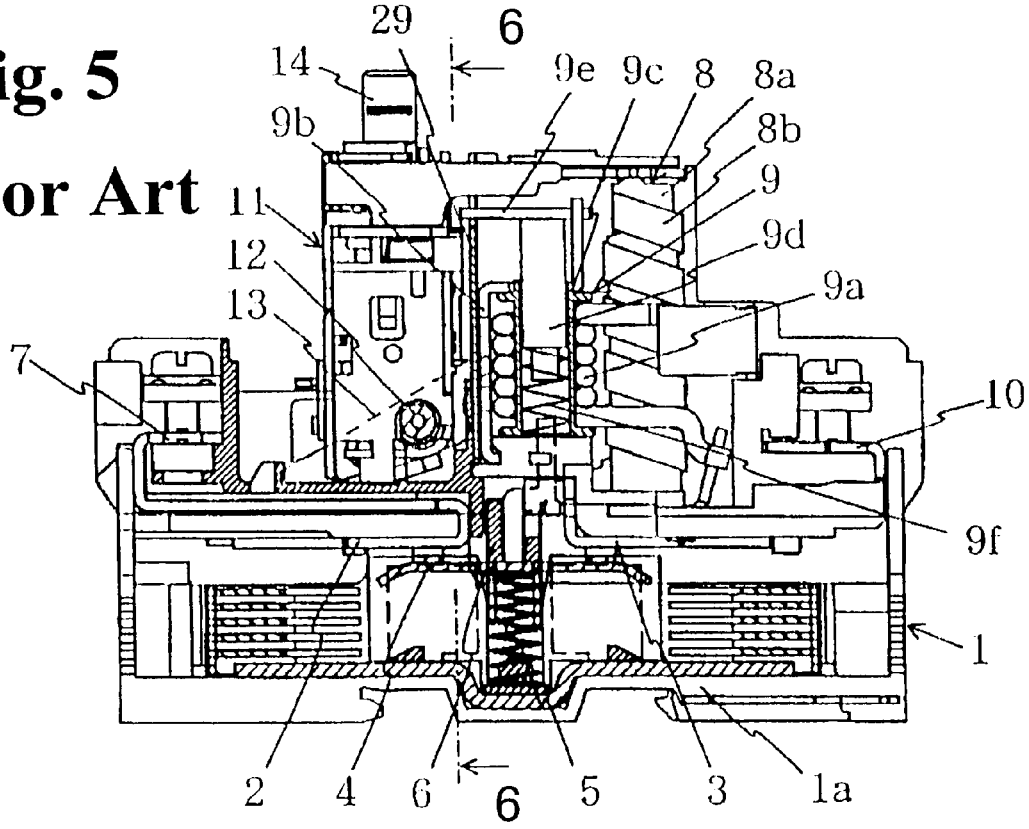
Fig. 5 Prior Art
FIG. 5 is a longitudinal sectional view showing a conventional protective switch.
Figure 6:
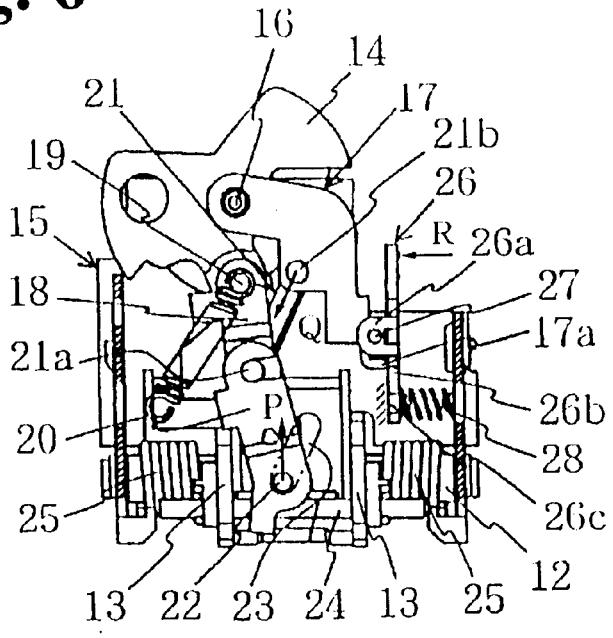
Fig. 6 Prior Art
FIG. 6 is a front view of a switching mechanism in a reset state taken along line (6)—(6) in FIG. 5.
Figure 7:
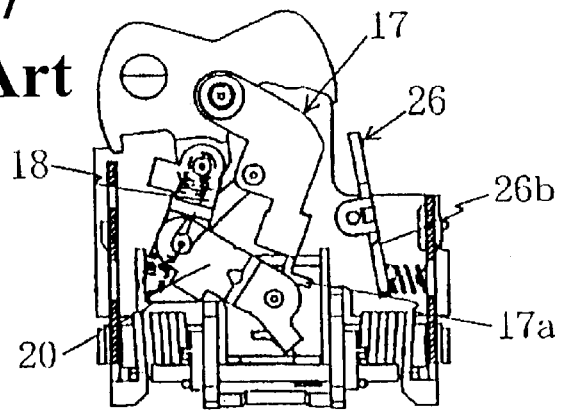
Fig. 7 Prior Art
FIG. 7 is a front view showing the switching mechanism in FIG. 6 in a tripping state.
Figure 8:
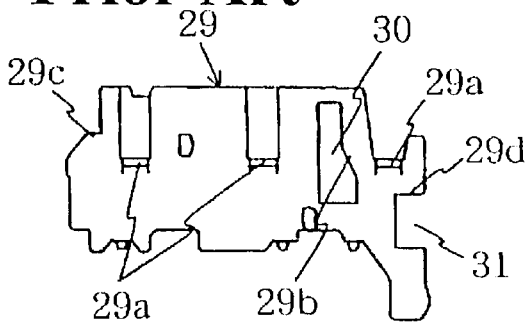
Fig. 8 Prior Art
FIG. 8 is a front view showing the trip member of the protective switch in FIG. 5.
Figure 10:
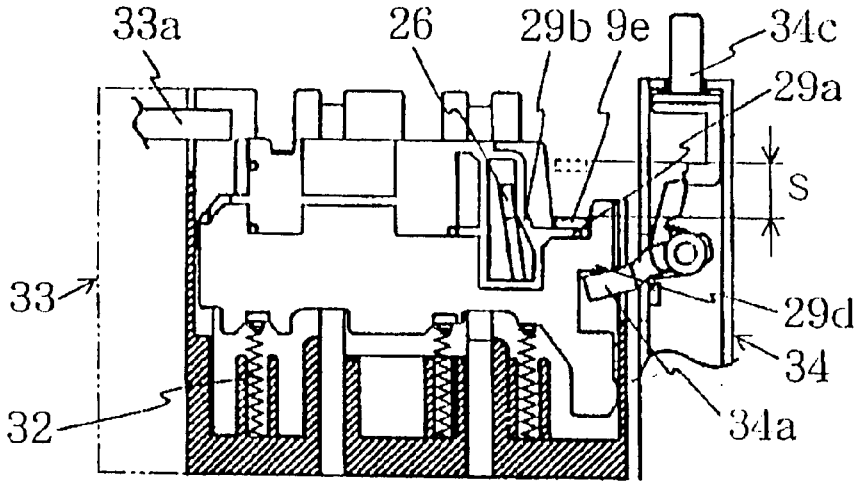
Fig. 10 Prior Art
FIG. 10 is a cross sectional view showing the trip member of the protective switch in FIG. 5, which is tripping in response to an operation of an instantaneous tripping mechanism.
Figure 11:
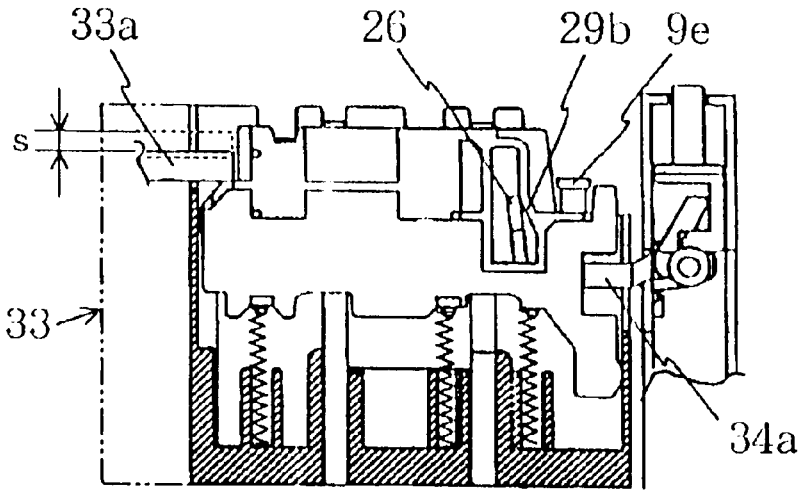
Fig. 11 Prior Art
FIG. 11 is a cross sectional view showing the trip member of the protective switch in FIG. 5, which is tripping in response to an operation of a tripping control device.

Hereunder, an embodiment of the present invention, in which the present invention is applied to the conventional protective switch in FIG. 5, will be described in detail with reference to the accompanied drawings. FIGS. 1, 2, and 3 are cross sectional views of a protective switch taken along a trip member 29, wherein FIG. 1 shows a reset state, FIG. 2 shows a tripping state caused by an instant current, and FIG. 3 shows a tripping state caused by a tripping control device. FIGS. 1, 2, and 3 correspond to FIGS. 9, 10, and 11, respectively, which show the prior art. FIG. 4 is an exploded front view showing a trip member. FIGS. 1 to 4 are different from the figures showing the prior art in that the trip member 29 is divided into an upper trip member 29A away from a housing bottom portion 1*a* and a lower trip member 29B close to the housing bottom portion 1*a*, represented by solid lines in FIG. 4. By joining the two dividing lines together, the upper trip member 29A and the lower trip members 29B are combined to constitute the trip member of the prior art in FIG. 8 as shown in FIG. 1.

The upper trip member 29A is formed of a plunger operating section 29*a* opposed to an operating member 9*e* of a plunger 9*d*, and a switch operating section 29*d* opposed to an actuator 34*a* of an alarm switch 34. The lower trip member 29B is formed of a latch receiver operating section 29*b* opposed to a latch receiver (locking member) 26, and a tripping device operating member 29*c* opposed to an operating member 33*a* of a tripping control device 33. Back springs 32 formed of compression springs are interposed between the lower trip member 29B and the housing bottom portion 1*a*. The lower trip member 29B is urged by the back springs 32 in a direction away from the housing bottom portion 1*a*, and at the same time, the upper trip member 29A is moved up via the lower trip member 29B. In the reset state in FIG. 1, the switch operating section 29*d* of the upper trip member 29A and the actuator 34*a* of the alarm switch 34 are positioned close to each other, and the gap G of the prior art in FIG. 9 is not provided between them.

Figure 9:
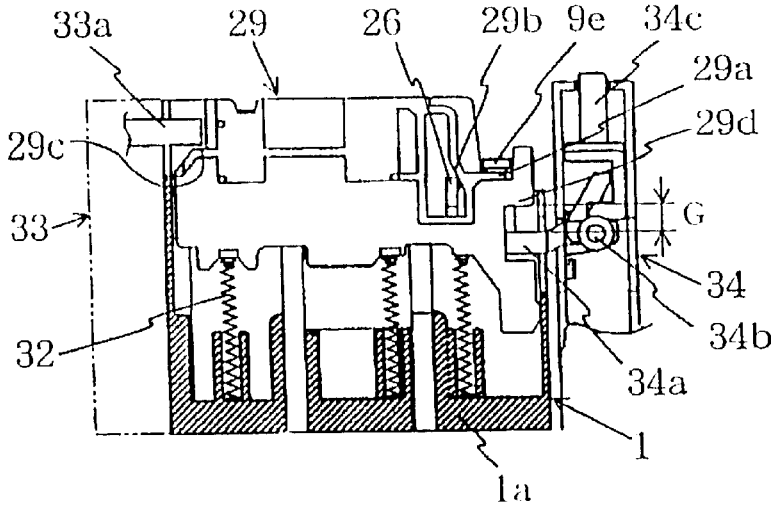
Fig. 9 Prior Art
FIG. 9 is a cross sectional view showing a principal part of a trip member of the protective switch in FIG. 5 in a reset state.

When an instant current flows in the state shown in FIG. 1, an instantaneous tripping mechanism 9 pulls the plunger 9*d* (FIG. 5), and as shown in FIG. 9, the operating member 9*e* pushes down the upper trip member 29A via the plunger operating section 9*a*. The lower trip member 29B is pushed down at the same time, and causes the latch receiver operating section 29*b* to move the latch receiver 26 to the left in FIG. 2. Consequently, a locked switching mechanism 11 is released to cause the protective switch to trip instantaneously. At the same time, the upper trip member 29A rotates the actuator 34*a* of the alarm switch 34 via the switch operating section 29*d*. Accordingly, the alarm contacts switch and transmit a trip signal, and a display rod 34*c* projects to indicate the occurrence of instantaneous tripping. In FIG. 1, the switch operating section 29*d* of the upper trip member 29A is positioned close to the actuator 34*a* of the alarm switch 34 as mentioned previously. For this reason, when the plunger 9*d* is pulled, the actuator 34*a* instantaneously rotates to surely operate the alarm switch 34 even if the instant current is in the lower limit range.

When the tripping control device 33 is operated in the state in FIG. 1, an operating member 33*a* moves downward to push down the lower trip member 29B as shown in FIG. 3. The latch receiver 26 moves to cause the protective switch to trip. On this occasion, with the downward movement of the lower trip member 29B, the upper trip member 29A tries to freely fall by its own weight, but a spring force of a torsion spring (not shown) mounted on the actuator 34*a* is set to such a force that the alarm switch 34 can not be released only by own weight of the upper trip member 29A. Therefore, as shown in FIG. 3, the upper trip member 29A stops in the state of being supported by the actuator 34A, and the alarm switch 34 is not operated. Namely, since the trip member 29 is divided into the upper and lower trip members and only the upper trip member 29B is pushed down during the tripping action caused by the tripping control device 33 according to the embodiment, the alarm switch 34 is not operated even if there is no gap G between the switch operating section 29*d* of the upper trip member 29A and the actuator 34*a* of the alarm switch 34.

In FIG. 2, note that the alarm switch 34 needs to be reset in order to reset the protective switch that has instantaneously tripped. In the instantaneous tripping state in FIG. 2 in which the alarm switch 34 is operated, the actuator 34 is locked by the display rod 34*c* after rotating counterclockwise. Therefore, the upper trip member 29A is locked downward by the actuator 34*a*, and the lower trip member 29B is held to be pushed down by the upper trip member 29A. As a result, the latch receiver 26 is kept pressed and bent by the upper trip member 29B, and the latch 17 of the switching mechanism 11 can not be engaged with the latch receiver 26.

In other words, the protective switch can not be reset or turned on and off unless the alarm switch 34 is reset. To reset the alarm switch 34, the projecting display rod 34*c* is pushed into the alarm switch 34. This releases the actuator 34*a* locked by the display rod 34*c*, so that the actuator 34*a* is rotated clockwise by a torsion spring (not shown) and is brought into contact with a stopper (not shown) to stop in the state in FIG. 1. At the same time, the lower trip member 29B is pushed upward by the back springs 32 while lifting the upper trip member 29A. This releases the latch receiver 26 from the latch receiver operating section 29*b* and causes the latch receiver 26 to return to the upright position, thus enabling resetting of the protective switch. The display rod 34*b* pushed into the alarm switch 34 then falls into a notch 34*d* of the actuator 34*a* (FIG. 2) to engage thereat, and kept in the embedded state.

As described hereinabove, according to the present invention, the trip member that transmits the operation of the instantaneous tripping mechanism and the tripping control device to the locking member of the switching mechanism is divided into the upper trip member and the lower trip member, so that the operation of the instantaneous tripping mechanism is transmitted from the upper trip member to the locking member via the lower trip member, and the operation of the tripping control device is transmitted to the locking member of the switching mechanism through the lower trip member irrespective of the upper trip member. This allows the actuator of the alarm switch, which warns the instantaneous tripping, to be disposed in proximity to the upper trip member, and surely operates the alarm switch in an entire range of the operational current of the instantaneous tripping mechanism.

While the invention has been explained with reference to the specific embodiment of the invention, the explanation is illustrative and the invention is limited only by the appended claims.

What is claimed is:

1. A protective switch comprising:

a switch housing having top and bottom surfaces, a switching mechanism arranged in the switch housing and having a movable contact, a locking member for locking the movable contact after closing the same, and a breaking spring for urging the movable contact to open when the movable contact is closed by the locking member, said movable contact being opened when the locking member unlocks the movable contact, a tripping mechanism disposed adjacent to the switching mechanism for instantaneously pulling the plunger upon detection of an instant current, said tripping mechanism having a plunger with a first operating member and a return spring for urging the plunger, a tripping control device mounted on one side of the switch housing and having a second operating member, an alarm switch mounted on the other side of the switch housing and having an actuator, a back spring disposed on the bottom surface of the switch housing, and a trip member disposed adjacent to the tripping mechanism to be moved vertically with respect to the bottom surface of the switch housing, and including an upper trip member away from the bottom surface of the switch housing and a lower trip member close to the bottom surface of the switch housing and urged by the back spring in a direction away from the bottom surface, said upper trip member having a plunger operating section facing the first operating member of the plunger and a switch operating section facing the actuator of the alarm switch, said lower trip member having a locking member operating section facing the locking member and a tripping section facing the second operating member of the tripping control device.

2. A protective switch according to claim 1, wherein said plunger moves the trip member toward the bottom surface of the switch housing via the plunger operating section upon detection of the instant current, and the second operating member moves the trip member toward the bottom surface of the switch housing via the tripping section during an operation of the tripping control device so that the switching mechanism is released to open the movable contact by moving the locking member operating section at the locking member; and the switch operating section operates the alarm switch via the actuator upon detection of the instant current.

3. A protective switch according to claim 1, wherein said tripping control device is a voltage tripping device or an under-voltage tripping device.

* * * * *